US010226773B2

(12) United States Patent
Lee et al.

(10) Patent No.: US 10,226,773 B2
(45) Date of Patent: Mar. 12, 2019

(54) MICRO HEATING DEVICE

(71) Applicant: ELECTRONICS AND TELECOMMUNICATIONS RESEARCH INSTITUTE, Daejeon (KR)

(72) Inventors: Dae-Sik Lee, Daejeon (KR); Moon Youn Jung, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 261 days.

(21) Appl. No.: 15/093,443

(22) Filed: Apr. 7, 2016

(65) Prior Publication Data

US 2016/0303566 A1 Oct. 20, 2016

(30) Foreign Application Priority Data

Apr. 20, 2015 (KR) ..... 10-2015-0055424

(51) Int. Cl.

*B01L 1/00* (2006.01)
*B01L 3/00* (2006.01)
*B01L 7/00* (2006.01)

(52) U.S. Cl.

CPC ..... *B01L 7/5255* (2013.01); *B01L 2200/10* (2013.01); *B01L 2200/147* (2013.01); *B01L 2300/0627* (2013.01); *B01L 2300/0809* (2013.01); *B01L 2300/0841* (2013.01); *B01L 2300/185* (2013.01)

(58) Field of Classification Search

CPC ..... B01L 7/525; B01L 7/5255; B01L 3/5027; B01L 2300/18; B01L 2300/0803; B01L 9/00

See application file for complete search history.

(56) References Cited

U.S. PATENT DOCUMENTS 5,176,203 A * 1/1993 Larzul ..... B01L 7/52 165/61
5,525,300 A * 6/1996 Danssaert ..... B01L 7/52 422/552

(Continued)

FOREIGN PATENT DOCUMENTS

KR 10-0450818 A 10/2004
KR 10-2010-0070977 A 6/2010

OTHER PUBLICATIONS

David J. You, et al., "Very quick reverse transcription polymerase chain reaction for detecting 2009 H1N1 influenza A using wire-guide droplet manipulations", Faraday Discussions, 2011, pp. 159-170, vol. 149, The Royal Society of Chemistry.

(Continued)

*Primary Examiner* — Nathan A Bowers

(57) ABSTRACT

A micro heating device according to an embodiment of the inventive concept comprises a support part having at least one or more heating part, an oil chamber positioned over the support part and filled with oil therein, a specimen chamber having a reaction space into which a specimen is loaded and which is provided so as to be dipped into the oil, and a drive part configured to move the specimen chamber in the oil. The specimen chamber includes a temperature sensor for measuring a temperature of the specimen chamber.

15 Claims, 16 Drawing Sheets

(56) References Cited

U.S. PATENT DOCUMENTS

| | | | | |
|---|---|---|---|---|
| 5,716,842 | A | 2/1998 | Baier et al. | |
| 6,503,750 | B1 | 1/2003 | Benett et al. | |
| 6,588,233 | B2 | 7/2003 | Benett et al. | |
| 2002/0022261 | A1* | 2/2002 | Anderson | B01F 11/0071 435/287.2 |
| 2005/0112754 | A1 | 5/2005 | Yoon et al. | |
| 2010/0159582 | A1 | 6/2010 | Ismail et al. | |
| 2011/0048952 | A1* | 3/2011 | Van Pelt | B01L 3/502715 204/600 |
| 2012/0264202 | A1 | 10/2012 | Walker et al. | |
| 2015/0024474 | A1* | 1/2015 | Chiou | B01L 7/5255 435/287.2 |
| 2017/0022866 | A1* | 1/2017 | Monge-Bonini | F01N 3/2066 |

OTHER PUBLICATIONS

David J. You, et al., "Droplet centrifugation, droplet DNA extraction, and rapid droplet thermocycling for simpler and faster PCR assay using wire-guided manipulations", Journal of Biological Engineering, 2012, pp. 1-10, vol. 6, No. 15.

* cited by examiner

MICRO HEATING DEVICE

CROSS-REFERENCE TO RELATED APPLICATIONS

This U.S. non-provisional patent application claims priority under 35 U.S.C. § 119 of Korean Patent Application No. 10-2015-0055424, filed on Apr. 20, 2015, the entire contents of which are hereby incorporated by reference.

BACKGROUND

The present disclosure herein relates to a micro heating device, and more particularly, to a micro heating device capable of performing a gene amplification process by using a bio lap-on-a-chip.

A polymerase chain reaction (PCR) which is a DNA amplification process is essential for the diagnosis and analysis of DNA-related diseases in a bio-micro electromechanical system (Bio-MEMS). To perform the polymerase chain reaction, a high-temperature environment of about 40° C. to about 100° C. should be provided. Here, to perform the polymerase chain reaction by using a medical lap-on-a-chip, a quick analysis is required for small power consumption suitable for portable batteries and a real-time diagnosis. Thus, a structure which may be thermally isolated and has a small thermal mass is required.

SUMMARY

An embodiment of the inventive concept provides a micro heating device including: a support part having at least one or more heating part; an oil chamber positioned over the support part and receiving oil therein; a specimen chamber having a reaction space into which a specimen is loaded and which is provided so as to be dipped into the oil; and a drive part configured to move the specimen chamber in the oil, the specimen chamber including a temperature sensor for measuring a temperature of the specimen chamber.

In an embodiment, the micro heating device may further include a control unit configured to control the specimen chamber and the drive part, and the control unit controls the drive part to stop the specimen chamber when a temperature measured by the temperature sensor reaches a preset temperature and to move the specimen chamber when the measured temperature deviates from the preset temperature.

In an embodiment, the oil chamber may be provided in a ring shape on the heating part.

In an embodiment, the drive part may include: a holder part configured to support the specimen chamber; a motor configured to move the holder part; and a guide rail configured to guide the motor so as to be moved along the oil chamber.

In an embodiment, the oil chamber may have a first radius, and the guide rail may have a same center as the oil chamber and may be provided in a ring shape having a second radius greater than the first radius.

In an embodiment, the guide rail may be formed along an outer circumference of the oil chamber.

Particularities of other embodiments are included in the detailed description and drawings.

BRIEF DESCRIPTION OF THE FIGURES

The accompanying drawings are included to provide a further understanding of the inventive concept, and are incorporated in and constitute a part of this specification.

The drawings illustrate exemplary embodiments of the inventive concept and, together with the description, serve to explain principles of the inventive concept. In the drawings.

DETAILED DESCRIPTION

Figure 1:
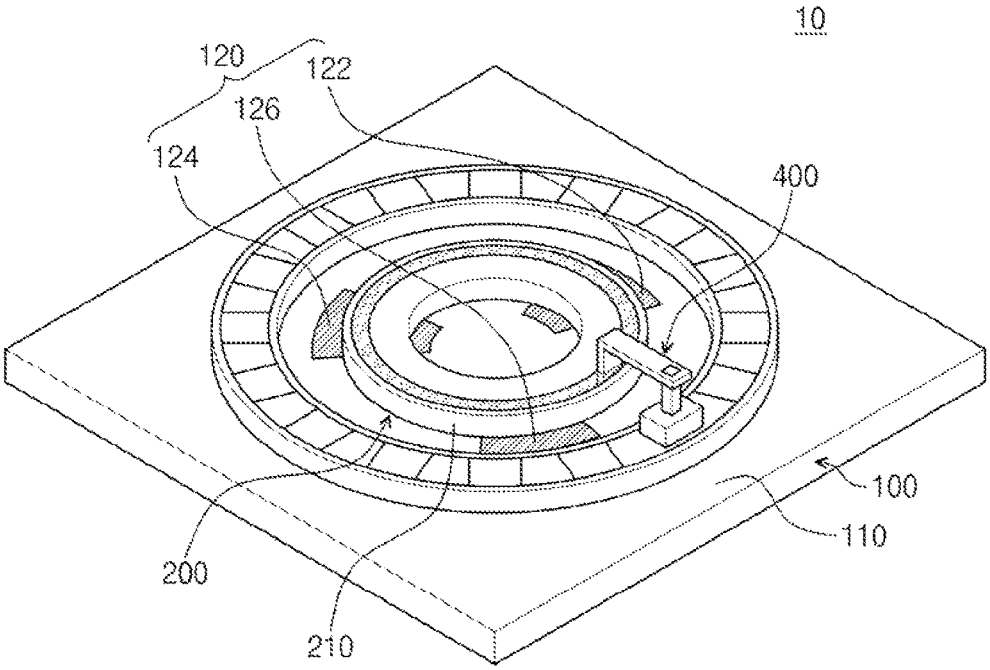
FIG. 1 is a schematic perspective view illustrating a micro heating device according to an embodiment of the inventive concept.

Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims. Like reference numerals refer to like elements throughout.

In the following description, the technical terms are used only for explaining a specific exemplary embodiment while not limiting the inventive concept. The terms of a singular form may include plural forms unless specifically mentioned. The meaning of 'comprises' and/or 'comprising' specifies a property, a region, a fixed number, a step, a process, an element and/or a component but does not exclude other properties, regions, fixed numbers, steps, processes, elements and/or components.

Additionally, the embodiment in the detailed description will be described with sectional views as ideal exemplary views of the present invention. In the figures, the dimensions of layers and regions are exaggerated for clarity of illustration. Accordingly, shapes of the exemplary views may be modified according to manufacturing techniques and/or allowable errors. Therefore, the embodiments of the present invention are not limited to the specific shape illustrated in the exemplary views, but may include other shapes that may be created according to manufacturing processes. For example, an etched region illustrated as a rectangle may have rounded or curved features. Areas exemplified in the drawings have general properties, and are used to illustrate a specific shape of a semiconductor package region. Thus, this should not be construed as limited to the scope of the present invention.

Figure 2:
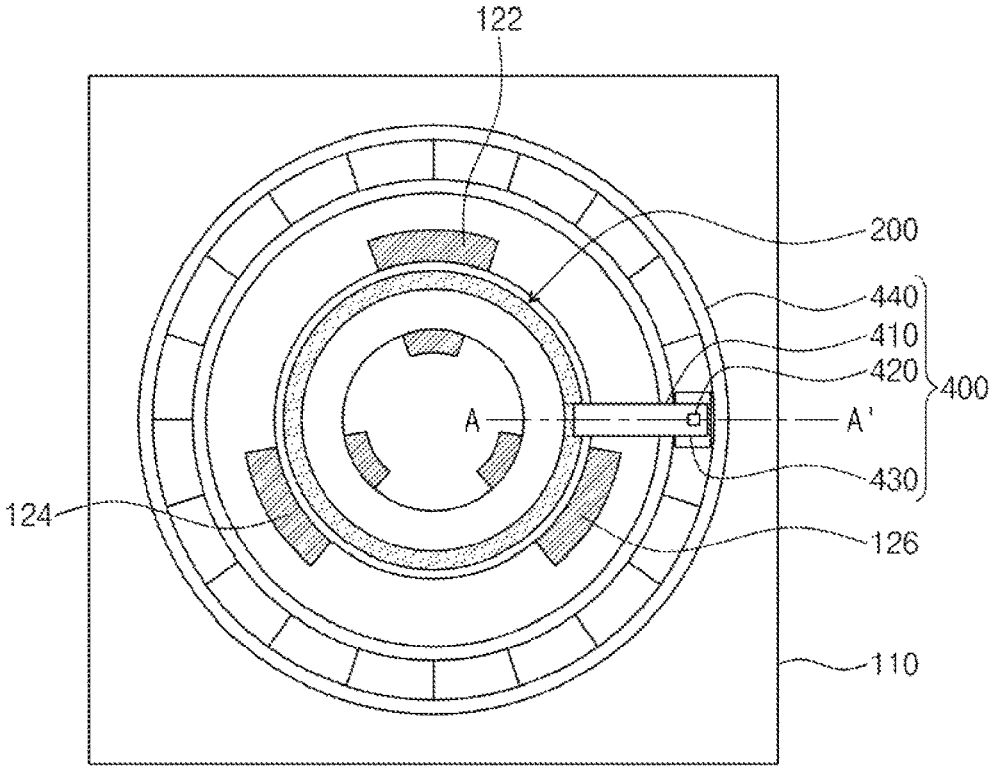
FIG. 2 is a top view of a micro heating device of FIG. 1.
Figure 3:
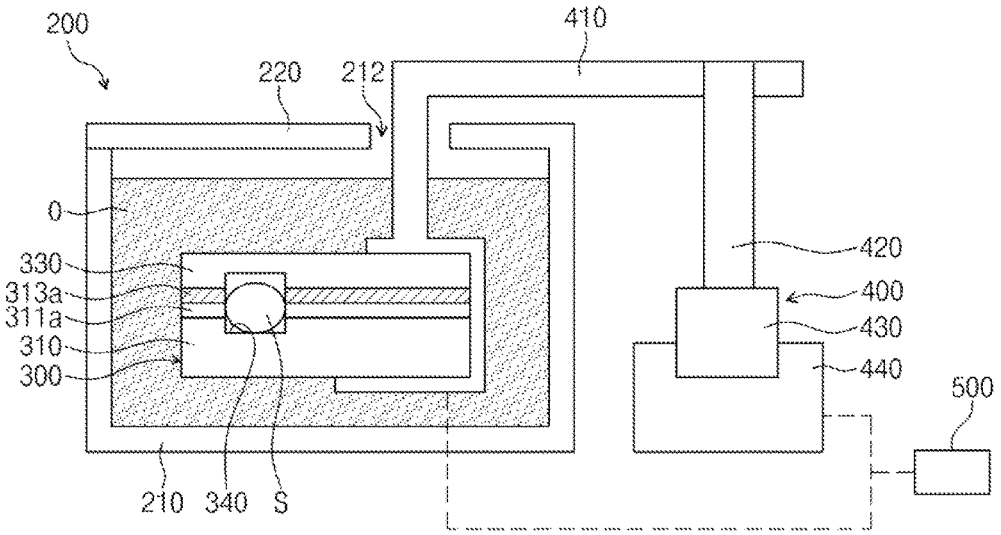
FIG. 3 is an enlarged cross-sectional view taken along line A-A' of FIG. 2.

FIG. 1 is a schematic perspective view illustrating a micro heating device 10 according to an embodiment of the inventive concept. FIG. 2 is a top view of a micro heating device 10 of FIG. 1. FIG. 3 is an enlarged cross-sectional view taken along line A-A' of FIG. 2.

Referring to FIGS. 1, 2, and 3, a micro heating device 10 according to an embodiment of the inventive concept may include a support part 100, an oil chamber 200, a specimen chamber 300, a drive part 400, and a control unit 500.

The support part 100 may be provided as a plate 110. The support part 100 may have at least one or more heating parts 120. The heating part 120 may be imbedded in the support part 100. The heating part 120 may be provided as a heating wire. For example, the heating part 120 may have a first heating part 122, a second heating part 124, and a third heating part 126. The first, second, and third heating parts 122, 124, and 126 may be provided so as to be spaced apart from one another. The first, second, and third heating parts 122, 124, and 126 may be sequentially positioned in one direction. For example, The first, second, and third heating parts 122, 124, and 126 may be sequentially positioned in a clockwise direction. The first heating part 122 may have a first set temperature. The second heating part 124 may have a second set temperature different from the first set temperature. The third heating part 126 may have a third set temperature different from the first and second set temperatures. For example, the first set temperature may be a temperature of about 90° C. to about 98° C., the second set temperature may be a temperature of about 50° C. to about 65° C., and the third set temperature may be a temperature of about 68° C. to about 75° C. Preferably, the first set temperature may be a temperature of about 94° C., the second set temperature may be a temperature of about 54° C., and the third set temperature may be a temperature of about 72° C.

The oil chamber 200 may be positioned on the support part 100. The oil chamber 200 may be positioned on the heating part 120. The oil chamber 200 may be provided in a ring shape. Unlike this, the oil chamber 200 may be provided in various shapes such as a circular or polygonal shape. As in FIGS. 1 and 2, the oil chamber 200 may be positioned on the first heating part 122, the second heating part 124, and the third heating part 126. The oil chamber 200 may have a housing 210, an opening 212, and a cover 220. Oil 0 may be received inside the housing 210. The housing 210 may be provided with an opened upper portion. An opening 212 may be formed at one side of the housing 210. For example, the opening 212 may be formed at one side upper portion. Through the opening 212, a holder part 410 of the drive part 400 may support the specimen chamber 300 inside the oil chamber 200. The cover 220 may cover the upper portion of the housing 210. The cover 220 may be provided detachable from the housing 210. The specimen chamber 300 may be loaded/unloaded into/from the oil chamber 200 by opening the cover 220.

The oil O may be mineral oil. The oil O may be a liquid or a solid at the room temperature. When the oil O exists as a solid at the room temperature, the oil O may have a melting point of the room temperature or higher. Here, the melting point of the oil O may be a temperature lower than the first, second, and third set temperatures. For example, the melting point of the oil O may be a temperature lower than about 50° C. The mineral oil O may have a high specific heat and may not be mixed with a specimen sample S.

The specimen chamber 300 may be provided so as to be immersed into the oil O in the oil chamber 200. The specimen chamber 300 may have a substrate 310, a reaction space 340, and a cover 330. The specimen chamber 300 may include an insulating thin film 311*a* formed on the substrate 310 and a temperature sensor 313*a*. The substrate 310 may be a silicon substrate. The substrate 310 may be provided with the reaction space 340. The specimen sample S may be loaded into the reaction space 340. The specimen sample S may be a micro sample. The specimen chamber 300 may be provided such that the reaction space 340 is immersed into the oil O. The specimen chamber 300 may include the cover 330 for covering the reaction space 340.

FIGS. 4A to 4L are views sequentially illustrating processes of manufacturing a specimen sample 300. FIGS. 4A to 4L are exaggerated for convenience in description. The specimen chamber 300 may be manufactured through a silicon micro manufacturing process based on a semiconductor photolithography process.

Figure 4A:
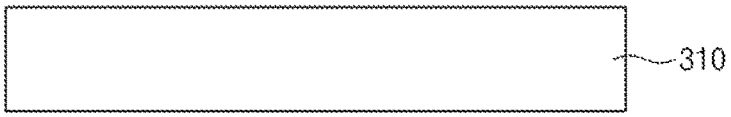
FIGS. 4A to 4L are views sequentially illustrating processes of manufacturing a specimen sample.

Referring to FIG. 4A, a substrate 310 is provided. The substrate 310 may include at least one selected from silicon, glass, plastic, metal, or a combination thereof. Preferably, the substrate 310 may be a silicon substrate.

Figure 4B:
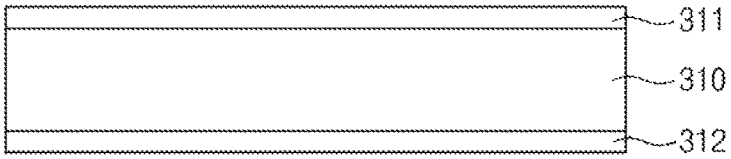

Referring to FIG. 4B, a first insulating thin film 311 may be formed on one side of the substrate 310. A second insulating thin film 312 may be formed on the other side of the substrate 310. The insulating thin films 311 and 312 may include at least one of silicon nitride, silicon oxide, or polymer. The polymer may be polymethyl methacrylate (PMMA), polyimide (PI), polycarbonate (PC), or cyclo-olefin copolymer (COC). The insulating thin films 311 and 312 may be simultaneously or sequentially formed. Due to the insulating thin films 311 and 312, the substrate 310 may be thermally isolated.

Figure 4C:
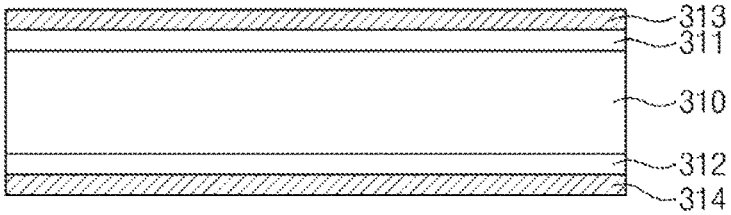

Referring to FIG. 4C, a first temperature sensor 313 may be formed on one side of the substrate 310. A second temperature sensor 314 may be formed on the other side of the substrate 310. For example, the temperature sensors 313 and 314 may be formed on the insulating thin films 311 and 312. The temperature sensors 313 and 314 may include thin film temperature sensors. The temperature sensors 313 and 314 measure temperatures. The temperature sensors 313 and 314 may measure the temperature of the specimen chamber 300. The temperature sensors 313 and 314 may include at least one of a precious metal such as platinum (Pt), gold (Au), or palladium Pd, a metallic compound thermocouple, or a metal oxide.

Figure 4D:
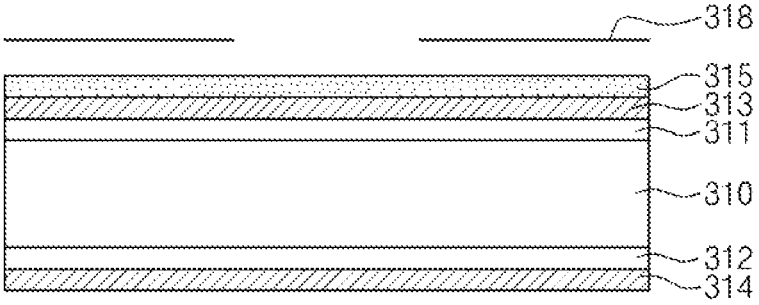
Figure 4E:
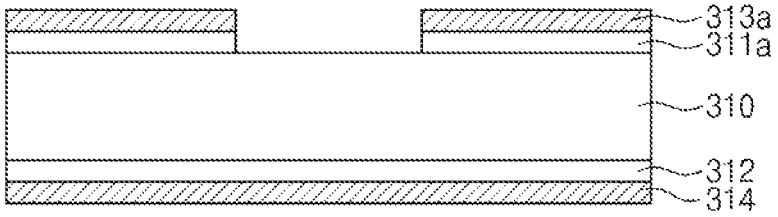

Referring to FIGS. 4D and 4E, photoresist 315 may be applied to one side of the substrate 310. The photoresist 315 may be formed on the first temperature sensor 313. A mask pattern 318 may be provided on the photoresist 315. A photo etching process may be performed by using a mask pattern 318 as a mask. Due to the photolithography process, only portions of the first temperature sensor 313*a* and the first insulating thin film 311*a* may remain. Due to this, the substrate 310 may be exposed on one side of the specimen chamber 300.

Figure 4F:
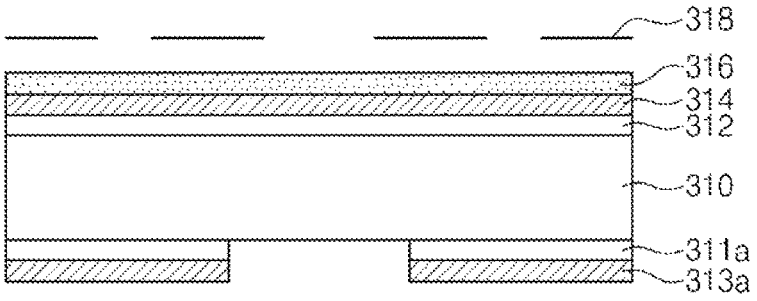
Figure 4G:
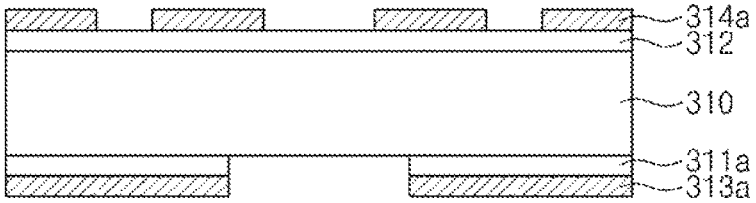

Referring to FIGS. 4F and 4G, a photoresist 316 may be applied to the other side of the substrate 310. The photoresist 316 may be formed on the second temperature sensor 314. A mask pattern 318 may be provided on the photoresist 316. A photo etching process may be performed by using the mask pattern 318 as a mask. Due to the photolithography process, only a portion of the second temperature sensor 314*a* may remain. Due to this, a second temperature sensor 314*a* may be patterned on the other side of the specimen chamber 300. Through the patterning process, the second temperature sensor 314*a* may have a resistance.

Figure 4H:
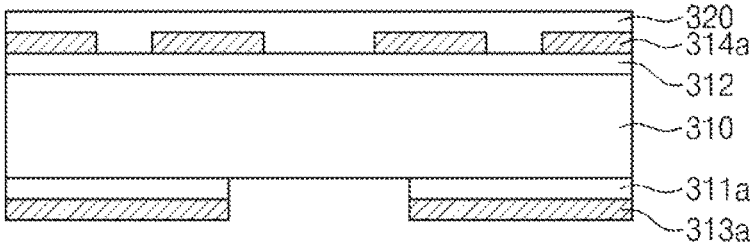
Figure 4I:
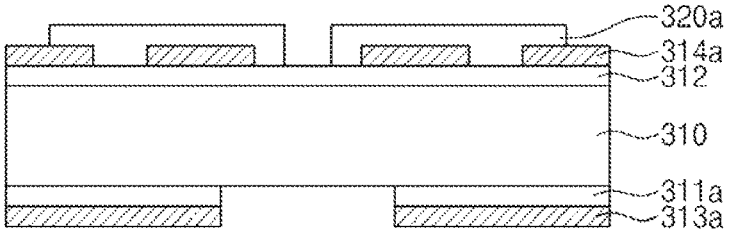

Referring to FIGS. 4H and 4I, an insulating thin film 320 may be formed on the other side of the substrate 310 and is then etched such that a portion of the insulating thin film 320 may be etched. An insulating thin film 320*a* may cover a portion of the patterned second temperature sensor 314*a*. The other remaining portion of the second temperature sensor 314*a* may be exposed. FIG. 3 does not illustrate the other side insulating thin films 312 and 320*a* of the specimen chamber 300 and the second temperature sensor 314*a*.

Figure 4J:
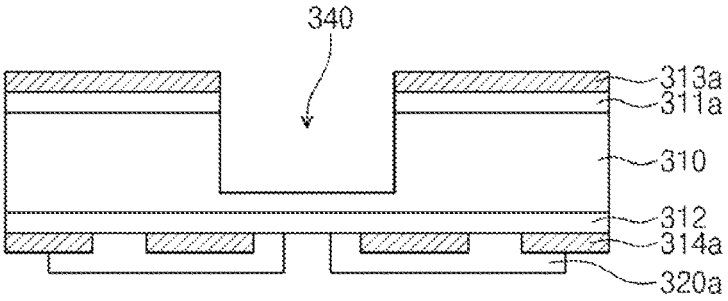

Referring to FIG. 4J, an etching process is performed again on one side of the specimen chamber 300. The substrate 310 may be etched on one side of the specimen chamber 300 by using a first temperature sensor 313*a* as a mask. Through this, a reaction space 340 may be formed inside the substrate 310.

Figure 4K:
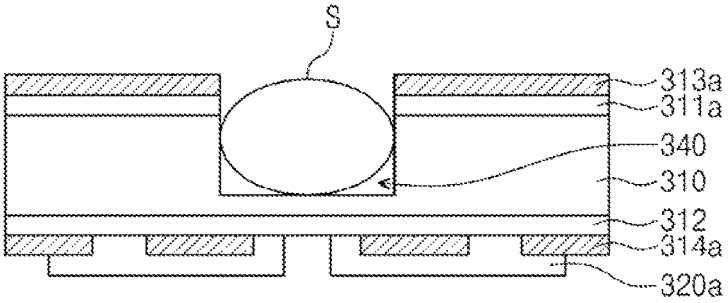
Figure 4L:
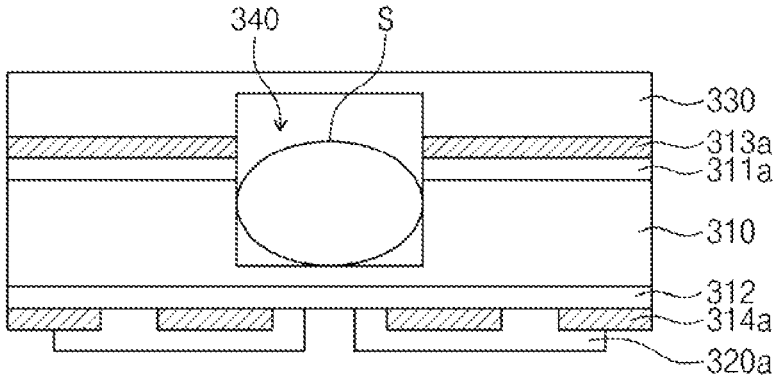

Referring to FIGS. 4K and 4L, the specimen sample S may be loaded into the reaction space 340. A sample cover 330 for covering the reaction space 340 may cover the one side of the specimen chamber 300. The reaction space 340 is covered by the sample cover 330, so that the loss and/or vaporization of the specimen sample S may be prevented.

Referring again to FIGS. 1, 2, and 3, the drive part 400 may move the specimen chamber 300. The drive part 400 may move the specimen chamber 300 inside the oil O in the oil chamber 200. The drive part 400 may have a holder part 410, a holder shaft 420, a motor 430, and a guide rail 440. The holder part 410 may support the specimen chamber 300. The holder part 410 may fix one side of the specimen chamber 300 such that the oil O may be filled in the reaction space 340. The holder shaft 420 may connect the holder part 410 with the motor 430. The motor 430 may supply power so that the holder part 410 may be moved. The guide rail 440 may guide the motor 430 so as to be moved along the oil chamber 200. The guide rail 440 may be provided in a shape corresponding to the oil chamber 200. For example, the guide rail 440 may be provided in a ring shape. When the oil chamber 200 is provided in a ring shape having a first radius, the guide rail 440 may have a second radius different from the first radius. The second radius may be greater than the first radius. Conversely, the second radius may be smaller than the first radius.

The control unit 500 may control the specimen chamber 300 and the drive part 400. The control unit 500 may control a position, a moving timing, and the like of the specimen chamber 300. The control unit 500 may be connected to a light source and a monitor part, and the gene amplification of the specimen sample S may thereby be monitored. For example, a fluorescence signal for treatment and analysis may be obtained. The control unit 500 may control the position of the specimen chamber 300 according to the temperature measured from the temperature sensor 314. When the temperature measured from the temperature sensor 313*a* reaches a predetermined temperature while moving the specimen chamber 300, the control unit 500 may stop the specimen chamber 300. When a predetermined time elapses after stopping the specimen chamber 300, the control unit 500 may move again the specimen chamber 300. When a gene amplification process is completed after stopping the specimen chamber 300, the control unit 500 may move again the specimen chamber 300. Also, when the temperature measured from the temperature sensor 313*a* deviates from a predetermined temperature after stopping the specimen chamber 300, the control unit 500 may move again the specimen chamber 300.

FIGS. 5 to 10 are views sequentially illustrating the processes of operating a micro heating device 10.

Figure 5:
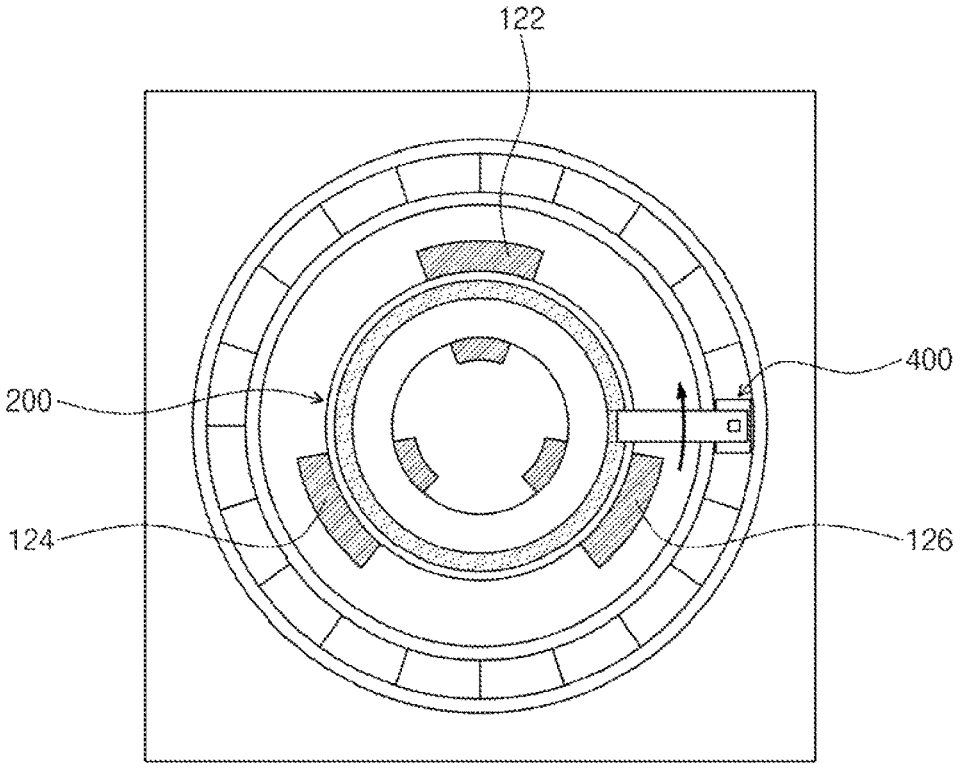
FIGS. 5 to 10 are views sequentially illustrating processes of operating a micro heating device.

Referring to FIGS. 3 and 5, a specimen sample S may be loaded into a reaction space 340 in a specimen chamber 300. A drive part 400 may provide the specimen chamber 300 so as to be immersed into oil O in an oil chamber 200. The oil O may provided in a liquid or solid phase at the room temperature. The oil O may be mineral oil. Here, the melting point of the oil O may be a temperature lower than first, second, and third set temperatures. For example, the melting point of the oil O may be a temperature lower than about 50° C. When the specimen sample S is loaded, a heating part 120 is started to be heated. As the heating part 120 is heated, the temperature of the oil O in the oil chamber 200 is increased such that the oil O in the oil chamber 200 has a liquid phase. A control unit 500 may control the drive part 400 so that the specimen chamber 300 is moved along the oil chamber 200. Accordingly, the specimen chamber 300 may be moved in one direction of the oil chamber 200.

Figure 6:
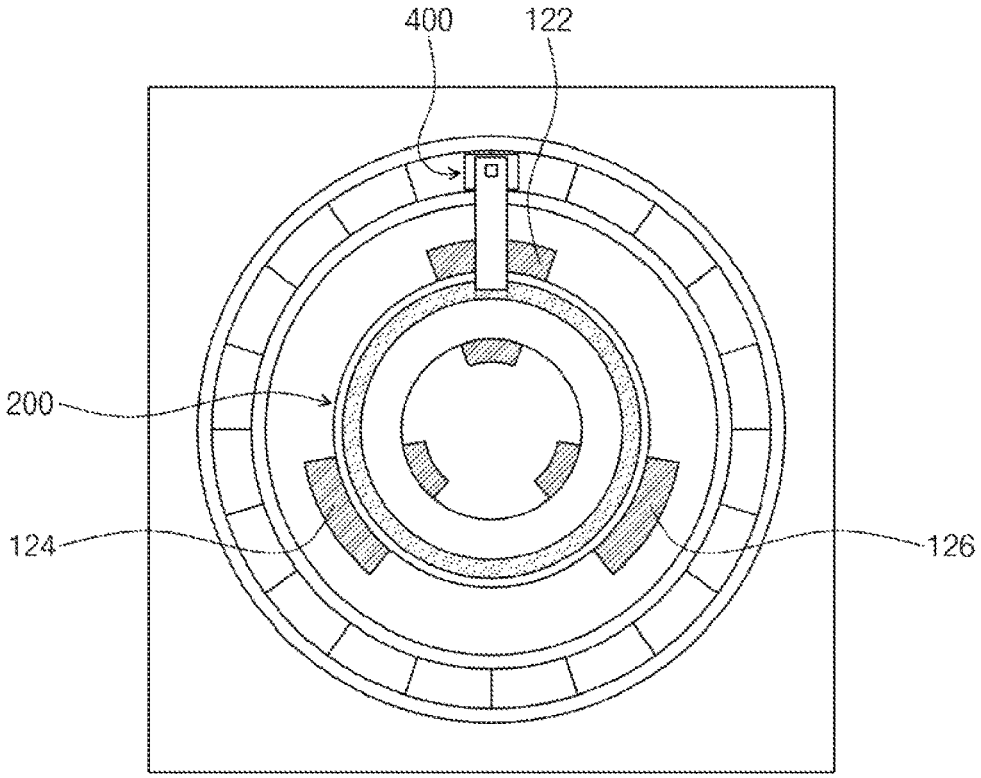

Referring to FIGS. 3 and 6, when the specimen chamber 300 is positioned over a first heating part 122, the temperature measured from a temperature sensor 313*a* may be the first set temperature. When the measured temperature is the first set temperature, the control unit 500 may control the drive part 400 to stop the specimen chamber 300. The first set temperature may be a temperature in the range of about 90° C. to about 98° C. Here, the specimen sample S may be denaturated. Therefore, two complementary strands of hydrogen bond of base are cut such that DNAs may be separated from each another.

Figure 7:
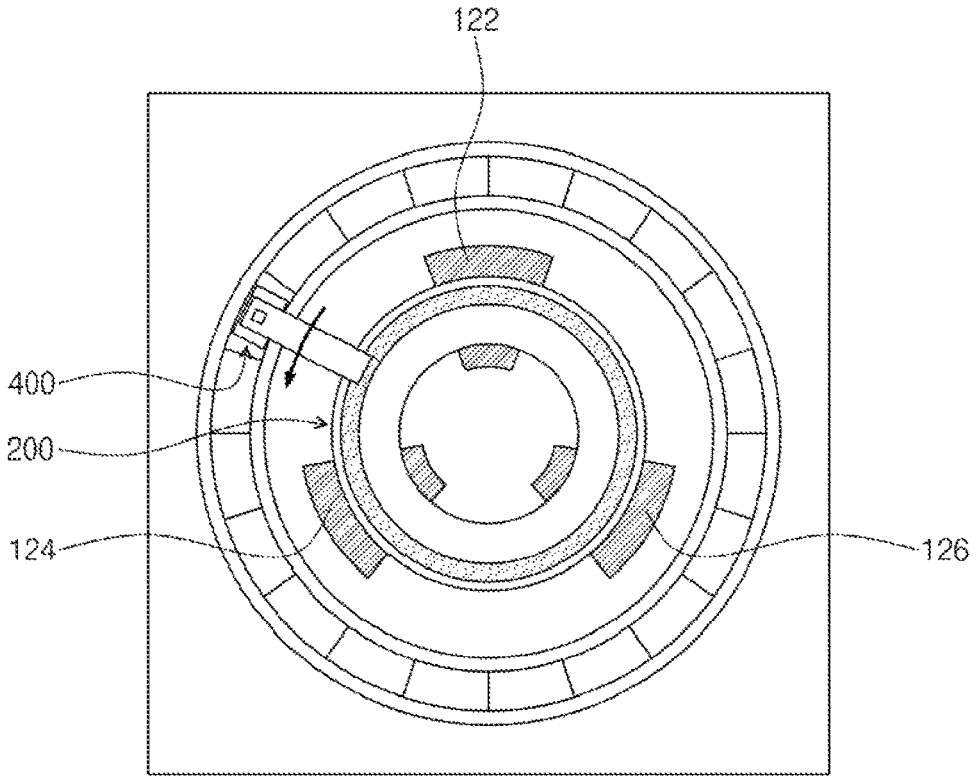

Referring to FIGS. 3 and 7, when the first set time elapses after the specimen chamber 300 is stopped over the first heating part 122, the drive part 400 may move again the specimen chamber 300. The specimen chamber 300 may be moved in one direction along the oil chamber 200. For example, the first set time may be in a range from about 30 seconds to about 1 minute. Selectively, when the temperature measured from the temperature sensor 313*a* deviates from the first set temperature, the drive part 400 may move again the specimen chamber 300. Alternatively, a user may control the moving timing of the specimen chamber 300 by monitoring the gene amplification process through the control unit 500.

Figure 8:
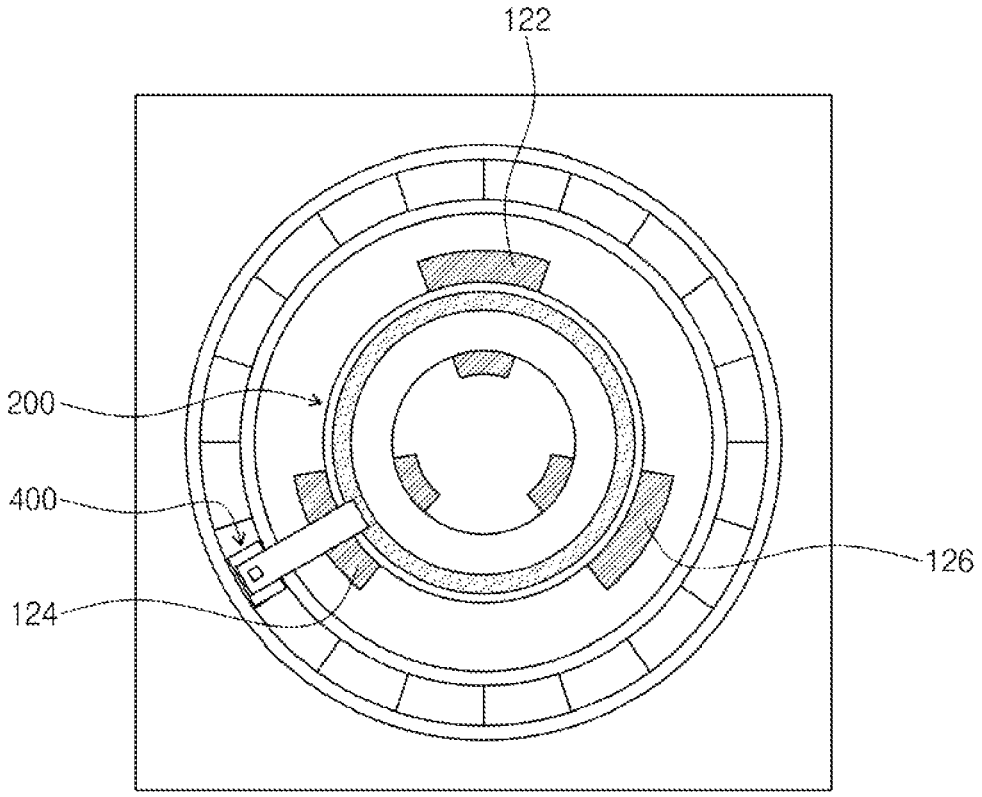

Referring to FIGS. 3 and 8, when the specimen chamber 300 is positioned over a second heating part 124, the temperature measured from the temperature sensor 313*a* may be the second set temperature. When the measured temperature is the second set temperature, the control unit 500 may control the drive part 400 to stop the specimen chamber 300. The second set temperature may be in the range from about 50° C. to about 65° C. Here, annealing may be performed in the specimen sample S. A primer may be coupled to the complementary base sequence in one strand of DNA separated due to thermal denaturation.

Figure 9:
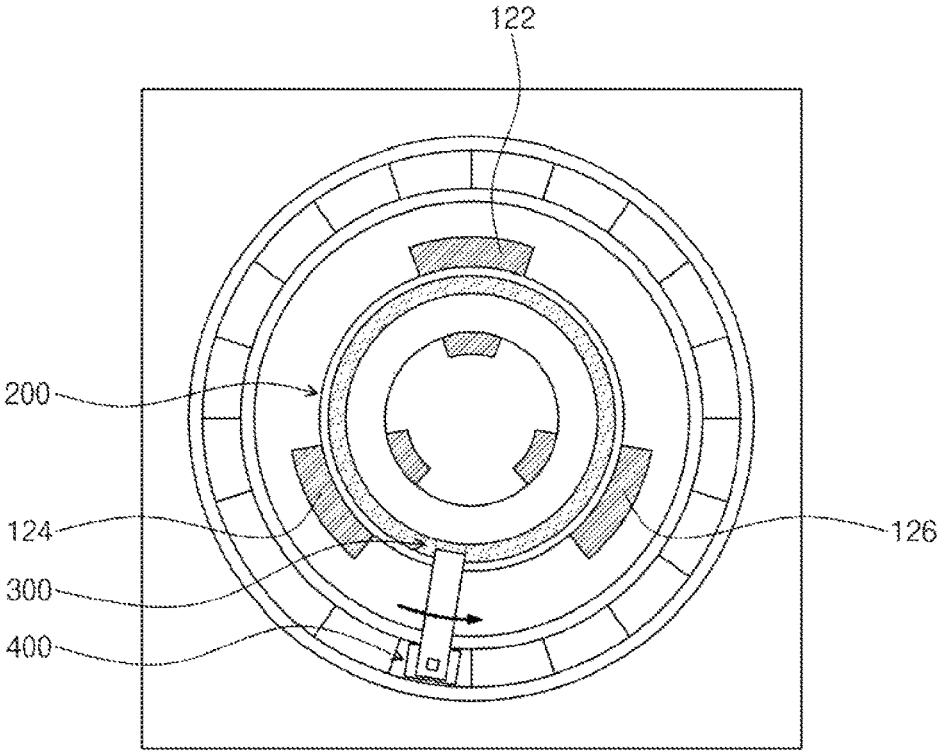

Referring to FIGS. 3 and 9, when the second set time elapses after the specimen chamber 300 is stopped over the second heating part 124, the drive part 400 may move again the specimen chamber 300. The specimen chamber 300 may be moved in one direction along the oil chamber 200. The second set time may be equal to or different from the first set time. Selectively, when the temperature measured from the temperature sensor 313*a* deviates from the first set temperature, the drive part 400 may move again the specimen chamber 300. Alternatively, a user may control the moving timing of the specimen chamber 300 by monitoring the gene amplification process through the control unit 500.

Figure 10:
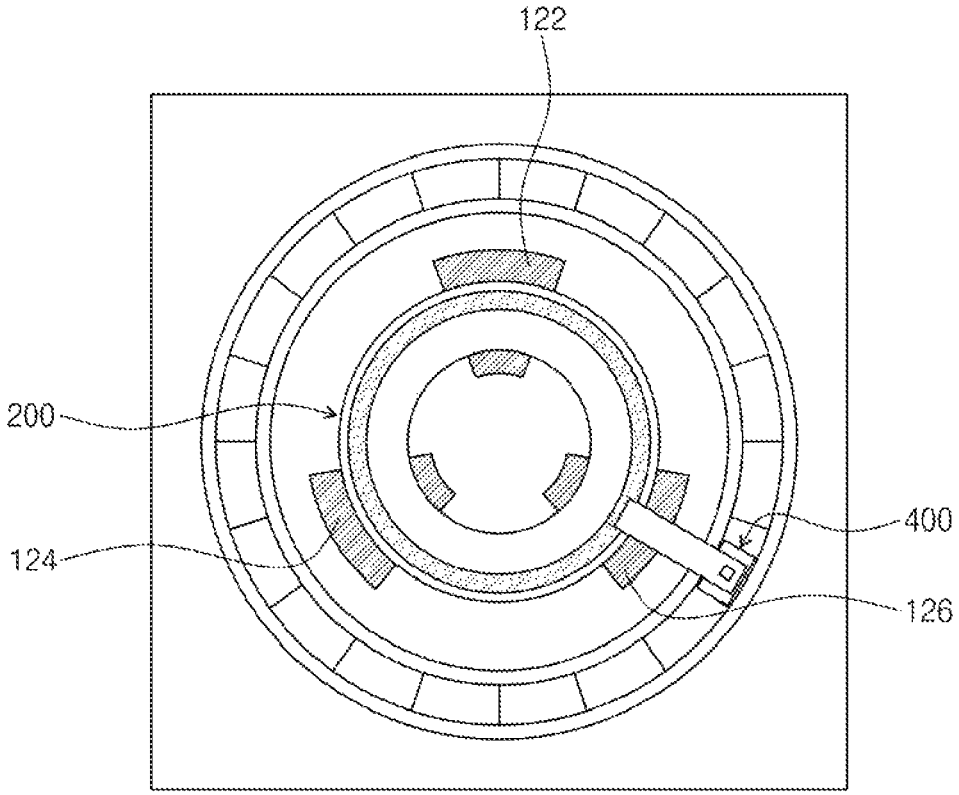

Referring to FIGS. 3 and 10, when the specimen chamber 300 is positioned over a third heating part 126, the temperature measured from the temperature sensor 313*a* may be the third set temperature. When the measured temperature is the third set temperature, the control unit 500 may control the drive part 400 to stop the specimen chamber 300. The third set temperature may be in the range from about 68° C. to about 75° C. Here, an extension reaction may be performed in the specimen sample S. Here, a complementary base of a template DNA is synthesized by using a DNA polymerization enzyme to a next base in which a primer is attached to one strand of DNA, and two strands of DNA may be extended.

When the third set time elapses after the specimen chamber 300 is stopped over the third heating part 126, the drive part 400 may move again the specimen chamber 300. The specimen chamber 300 may be moved in one direction along the oil chamber 200. The third set time may be equal to or different from the first set time and the second set time. Selectively, when the temperature measured from the temperature sensor 313*a* deviates from the third set temperature, the drive part 400 may move again the specimen chamber 300. Alternatively, a user may control the moving timing of the specimen chamber 300 by monitoring the gene amplification process through the control unit 500.

While the specimen chamber 300 is rotated along the oil chamber 200, the denaturation process, the annealing reaction, and the extension reaction may be respectively performed in the first, second, and third heating parts 122, 124, and 126. The control unit 500 may amplify DNA while repeatedly rotating the specimen chamber 300. When the polymerization enzyme extension reaction is repeated n times, the gene amplification of $2^n$ times may be performed. When the gene amplification process is completed, a user may perform the gene amplification process by replacing the specimen sample S.

An accurate and uniform temperature control may be performed by detecting the temperature of the specimen chamber 300 at a specific temperature range and stopping for a specific time. Also, the micro heating device 10 may amplify genes in a short time because there is nearly no ramping interval. The micro heating device 10 may be mass-manufactured due to the simple configuration thereof and may be used for an on-site diagnosis due to low costs thereof.

Figure 11:
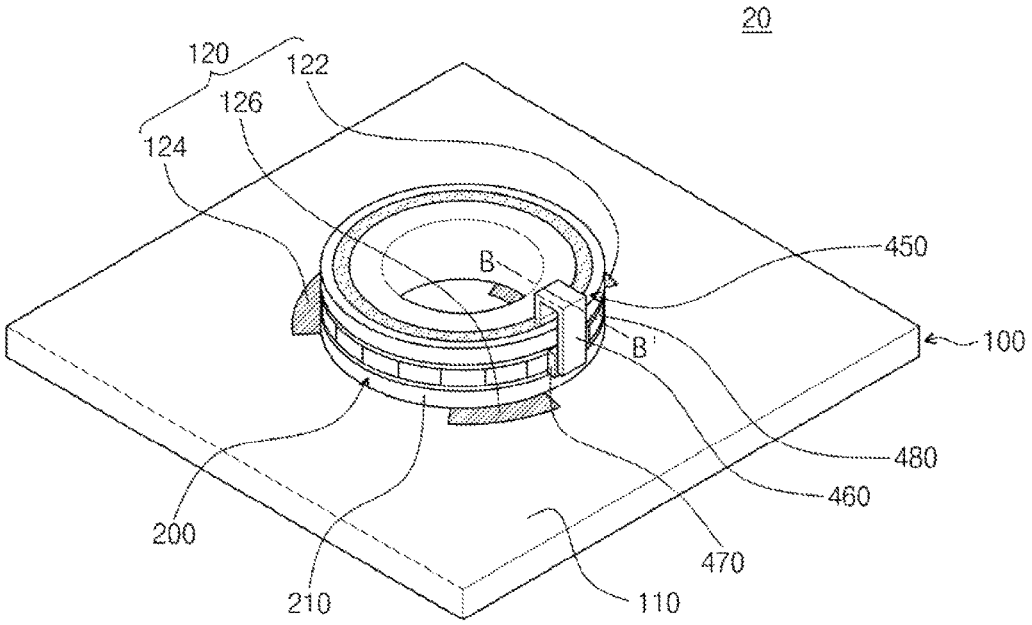
FIG. 11 is a schematic perspective view illustrating a micro heating device according to an embodiment of the inventive concept.
Figure 12:
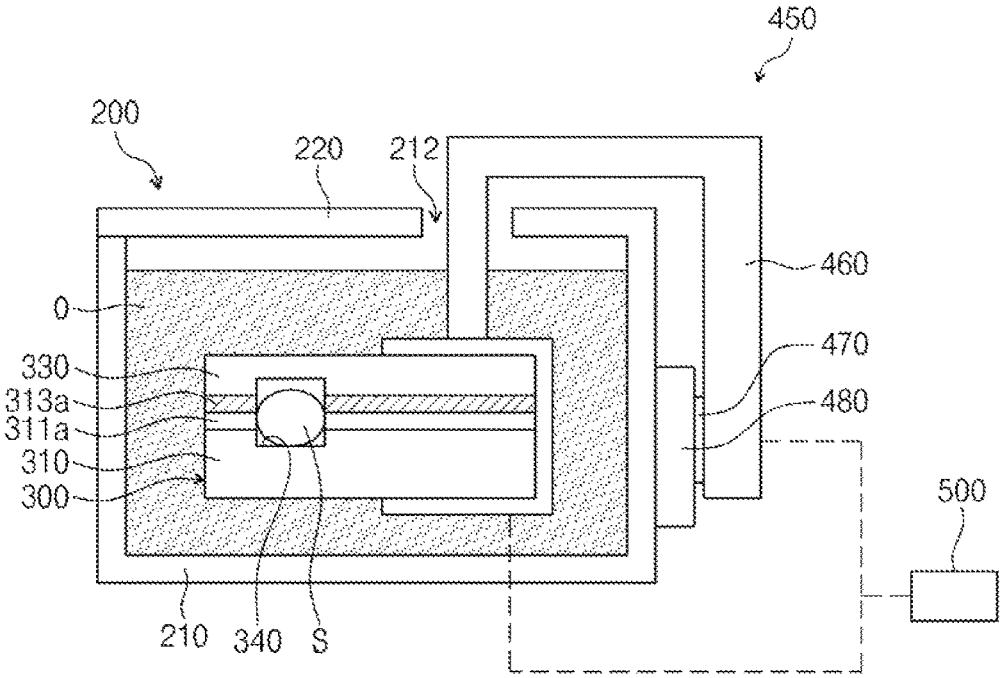
FIG. 12 is an enlarged cross-sectional view taken along line B-B' of FIG. 11.

FIG. 11 is a schematic perspective view illustrating a micro heating device 20 according to another embodiment of the inventive concept. FIG. 12 is an enlarged cross-sectional view taken along line B-B' of FIG. 11. A micro heating device 20 may include a support part 100, an oil chamber 200, a specimen chamber 300, a drive part 450, and a control unit 500. In this embodiment, each of the support part 100, the oil chamber 200, the specimen chamber 300, and the control unit 500 are substantially the same as the support part 100, the oil chamber 200, the specimen chamber 300, and the control unit 500 in FIG. 1, and thus the detailed description thereof will not be provided.

Referring to FIGS. 11 and 12, the drive part 450 may have a holder part 460, a motor 470, and a guide rail 480. The drive part 450 may move the specimen chamber 300. The drive part 450 may move the specimen chamber 300 inside oil O in the oil chamber 200. The holder part 460 may support the specimen chamber 300. The holder part 460 may fix one side of the specimen chamber 300 such that the oil O may be filled in the reaction space 340. The motor 470 may supply power so that the holder part 460 may be moved, for example, along the guide rail 480. The guide rail 480 may guide the motor 470 so as to be moved along the oil chamber 200. The guide rail may be provided so as to be coupled to the oil chamber 200. For example, the guide rail 480 may be coupled to an outer wall of the oil chamber 200. The guide rail 480 may be provided in a shape corresponding to the oil chamber 200. The guide rail 480 may be provided in a ring shape. When the guide rail is coupled to the oil chamber 200, a total area occupying ratio is decreased, so that space efficiency may be increased.

In the above-described embodiments, the oil chamber 200 is described to have a ring shape as an example. However, the oil chamber 200 may be provided in various shapes other than the ring shape. For example, the oil chamber 200 may be provided in a circular or polyhedral shape. Also, three heating parts 120 are described as an example, but various numbers of the heating parts other than three may be provided. Also, the manufacturing process of the specimen chamber 300 is described such that the insulating films 311 and 312 and the temperature sensors 313 and 314 are respectively formed on both sides of the substrate 310 as an example, but unlike this, the insulating films 311 and 312 and the temperature sensors 313 and 314 may be formed in multi layers or on only one side of the substrate.

According to embodiments of the inventive concept, a micro heating device capable of performing an accurate and uniform temperature control may be provided. Also, a micro heating device capable of efficiently performing a polymerase chain reaction in a short time may be provided.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description. Therefore, the above-described embodiments are illustrative in all the aspects, and should be construed as not being limitative.

What is claimed is:

1. A micro heating device comprising:

a support part including one or more heating parts;

an oil chamber positioned over the support part and receiving oil therein;

a specimen chamber having a reaction space into which a specimen is loaded, the specimen chamber being disposed in the oil; and a drive part configured to move the specimen chamber in the oil, wherein the specimen chamber comprises a temperature sensor configured to measure a temperature of the specimen chamber, wherein a gap is provided between the oil chamber and the specimen chamber, the gap configured to receive the oil, and wherein the drive part comprises:

a holder part configured to suspend the specimen chamber in the oil; and a motor disposed outside of the oil chamber and configured to move the holder part, wherein the motor is separated apart from the specimen chamber in a plan view.

2. The micro heating device of claim 1, further comprising a control unit configured to control the specimen chamber and the drive part, wherein the control unit controls the drive part to move the specimen chamber along the oil chamber when a temperature measured by the temperature sensor reaches a first preset temperature, and to stop the specimen chamber when the temperature measured by the temperature sensor reaches a second preset temperature.

3. The micro heating device of claim 2, wherein the control unit controls the drive part to move the specimen chamber along the oil chamber when a set time elapses after the control unit stops the specimen chamber.

4. The micro heating device of claim 3, wherein the oil chamber is provided in a ring shape on the one or more heating parts.

5. The micro heating device of claim 4, wherein the one or more heating parts are a plurality of heating parts, and the plurality of heating parts are disposed along the ring shape.

6. The micro heating device of claim 5, wherein the drive part further comprises:

a guide rail configured to guide the motor so as to be moved along the oil chamber.

7. The micro heating device of claim 6, wherein the oil chamber has a first radius, and wherein the guide rail has a ring shape having a second radius that is greater than the first radius, the oil chamber and the ring shape of the guide rail having a same center.

8. The micro heating device of claim 6, wherein the guide rail is formed along an outer circumference of the oil chamber.

9. The micro heating device of claim 8, wherein the surface of the reaction space is hydrophobically treated.

10. The micro heating device of claim 9, wherein the temperature sensor comprises one or more of a metal, a metal compound, a thermocouple, and a metal oxide.

11. The micro heating device of claim 10, wherein the reaction space is formed on a substrate, and the specimen chamber further comprises a cover configured to cover an upper portion of the reaction space.

12. The micro heating device of claim 2, wherein the control unit controls the drive part to move the specimen chamber again along the oil chamber when the measured temperature deviates from the second preset temperature after the control unit stops the specimen chamber.

13. The micro heating device of claim 1, further comprising the oil disposed in the oil chamber.

14. The micro heating device of claim 13, wherein the oil is disposed above and below the specimen chamber.

15. The micro heating device of claim 1, wherein each outer surface of the specimen chamber is spaced apart from each interior surface of the oil chamber by the oil.

* * * * *